US006058626A

United States Patent [19]

De Vroome et al.

[11] Patent Number: 6,058,626

[45] Date of Patent: May 9, 2000

[54] DRYER FOR A MATERIAL WEB WITH EXHAUST GAS RECIRCULATION

[75] Inventors: Clemens De Vroome, Beugen; Franciscus Ernst, Vortum-Mullem, both of Netherlands

[73] Assignee: Heidelberger Druckmaschinen AG, Heidelberg, Germany

[21] Appl. No.: 09/053,437

[22] Filed: Apr. 1, 1998

[30] Foreign Application Priority Data

Apr. 1, 1997 [DE] Germany ..... 197 13 529

[51] Int. Cl.[7] ..... F26B 21/00

[52] U.S. Cl. ..... 34/539; 34/566; 34/630; 34/649

[58] Field of Search ..... 34/494, 538, 539, 34/544, 545, 546, 566, 630, 649, 651; 438/8, 21, 59, 72; 110/210, 211, 214

[56] References Cited

U.S. PATENT DOCUMENTS

| | | | |
|---|---|---|---|
| 4,905,381 | 3/1990 | Poterala | 34/634 |
| 4,929,173 | 5/1990 | Jacobs et al. | 431/215 |
| 4,944,673 | 7/1990 | Jacobs et al. | 432/59 |
| 4,952,145 | 8/1990 | Kwiatkowski et al. | 432/59 |
| 4,989,348 | 2/1991 | Vits | 34/630 |
| 5,038,495 | 8/1991 | Jacobs et al. | 34/62 |
| 5,584,131 | 12/1996 | Van Liempt et al. | 34/576 |
| 5,718,062 | 2/1998 | De Vroome | 34/494 |

*Primary Examiner*—Stephen Gravini
*Attorney, Agent, or Firm*—Herbert L. Lerner; Laurence A. Greenberg; Werner H. Stemer

[57] ABSTRACT

A dryer for material webs for supplying heat to at least one side of a material web, the dryer having a dryer housing formed with an inlet opening and an outlet opening for material webs, and at least one ventilator and at least one heating device for producing heated gas, includes a burner unit shielded against the atmosphere in the dryer, and a supply system for supplying the burner unit with process gas formed of a large portion of exhaust gas of the dryer, the process gas being maintained for a dwell time and at a temperature level adequate for complete combustion of volatile solvents before it is supplied once again as heated gas to the interior of the dryer.

17 Claims, 4 Drawing Sheets

DRYER FOR A MATERIAL WEB WITH EXHAUST GAS RECIRCULATION

BACKGROUND OF THE INVENTION

1. Field of the Invention

The invention relates to a dryer for material webs, with exhaust gas recirculation.

The published European Patent Document EP 0 723 126 A1 has heretofore disclosed a control device for a continuous drying process of an industrial dryer. Solvent-laden air circulates in a continuous-flow dryer with progressive heating. A process is disclosed for the optimal control of the solvent-laden air. The condensation of solvents and various products based on solvent compounds is effectively reduced or even prevented. In addition to the reduction of condensation, a more intensive and more uniform mixing of the atmosphere within the dryer is achieved, by which the reliability is increased and the drying process is simplified because areas with a high solvent concentration are reduced. Ambient air is heated within the dryer and mixed with the solvent-laden air. The mixed air is supplied to a first zone of the dryer. In this construction, an open flame is cooled from the outside by relatively cold air.

A considerable reduction in the exhaust gas volume to the afterburning device cannot be achieved with the embodiment according to the aforementioned publication EP 0 723 126 A1. With this embodiment, ambient air is used for the purpose of cooling the open flame of the burner and to prevent cracking of volatile solvent residues. The dwell time of the combustion air mixture in the burner is not long enough to completely burn the volatile solvent components.

The published European Patent Document EP 0 264 637 B1 relates to a continuous-flow dryer for material webs, in particular an offset dryer. The material web is provided, on one or both sides thereof, with blast nozzles acting thereon with heated air, with at least one ventilator which supplies the blast nozzle with ambient air, and with at least one gas-fed heating device for the ambient air and an afterburning device for the ambient air. An inlet slot and an outlet slot are provided for the material web wherein, in the region of at least one of these slots, mixing chambers are provided above and below the plane of material web guidance equipment and the fresh air flowing in via the inlet slot and if need be, the outlet slot, is mixed with hot gases of the afterburning device in these mixing chambers. Outlets are provided to the interior of the dryer, wherein each heating device and afterburning device supplied with gas and ambient air of the dryer are combined into one unit and have a closed combustion chamber in the dryer housing.

According to this embodiment of the aforementioned publication EP 0 264 637 B1, each heating and afterburning device is supplied with gas and ambient air of the dryer, closed combustion chambers being disposed inside the dryer. Through the intermediary of this embodiment, air, instead of exhaust gas, is supplied once more to the heating devices, by which the volume to be supplied to the afterburning devices does not decrease significantly. Consequently, the gas consumption of the afterburning devices likewise cannot be significantly reduced.

The published European Patent Document EP 0 326 227 A1 discloses a dryer for a material web. The dryer, which is provided for an offset printing machine, in particular, includes a housing formed with an inlet slot and an outlet slot for the material web. The housing is equipped with blast nozzles, which are supplied with ambient air from inside the dryer via one or more ventilators. The housing, furthermore, includes a heating device with a burner in order to change the atmosphere inside the dryer. The inside of the housing is divided by a partition into a heating zone and a vaporizing or evaporation zone. The heating device, furthermore, includes another zone from which a portion of the heated air is supplied to the heating zone via an outlet opening, while the remainder of the heated air is conducted back to the ambient air. The atmosphere in the evaporation zone serves as combustion air for the burner of the heating device.

In this embodiment, the entire exhaust gas volume is supplied to an afterburning device, an economical embodiment being proposed by the embodiment according to the invention.

In the MEG company brochure, "MEG Operating Description SDE", page MC 10, dated Jul. 5, 1996, there is disclosed a dryer which is divided into a number of zones. In the first zone, the web temperature increases due to the supply of heated air from the combustion chambers. Thereafter, the evaporation of solvents begins. The evaporation of solvents is finished in the second zone of the dryer, which is separated from the first zone by a vertical partition formed with an opening. The required thermal energy is provided by heated air passing from the first zone into the second zone through the opening formed in the partition. The solvents are blown out via an exhaust gas ventilator, which also transports energy between the zones. This embodiment uses separate exhaust gas and ambient air ventilators because the exhaust gas is conducted directly out of the dryer.

SUMMARY OF THE INVENTION

In view of the foregoing heretofore known embodiments of the prior art, it is an object of the invention to provide a dryer for a material web with exhaust gas recirculation wherein energy consumption is drastically reduced during the operation of the dryer. Another object of the invention of the instant application is to reduce considerably the exhaust gas volume flow that is conveyed to an afterburning device and, consequently, to reduce the energy consumption in the afterburner, as well. Finally, an object of the invention is to equip a dryer with a simple and reliable energy transport system without additional ventilators or support burners being required.

With the foregoing and other objects in view, there is provided, in accordance with the invention, a dryer for material webs for supplying heat to at least one side of a material web, including a dryer housing formed with an inlet opening and an outlet opening for material webs, and at least one ventilator and at least one heating device for producing heated gas, comprising a burner unit shielded against the atmosphere in the dryer, and a supply system for supplying the burner unit with process gas formed of a large portion of exhaust gas of the dryer, the process gas being maintained for a dwell time and at a temperature level adequate for complete combustion of volatile solvents before it is supplied once again as heated gas to the interior of the dryer.

In accordance with another feature of the invention, the burner unit is a process air burner.

In accordance with a further feature of the invention, the dryer includes an actuatable adjusting element for controlling exhaust gas volume flow.

In accordance with an added feature of the invention, the dryer includes a plurality of zones formed therein.

In accordance with an additional feature of the invention, the dryer is operatable in accordance with the counterflow principle.

In accordance with yet another feature of the invention, the dryer is operatable in accordance with the uniflow principle.

In accordance with yet a further feature of the invention, the dryer comprises a pipe system, the actuatable adjusting element being disposed in the pipe system.

In accordance with yet an added feature of the invention, the dryer comprises a pipe system including an exhaust gas pipe, the actuatable adjusting element being disposed in the exhaust gas pipe.

In accordance with yet an additional feature of the invention, the dryer includes equipment for conveying heat energy to the respective zones of the dryer.

In accordance with still another feature of the invention, the equipment for conveying the heat energy is a pipe system for distributing the heat energy to the respective zones.

In accordance with still a further feature of the invention, the pipe system includes pipe sections having a respective cross section which diminishes over the length of the pipe system.

In accordance with still an added feature of the invention, the dryer includes first ventilators for receiving a supply of heated gas, the first ventilators being disposed at a transition region from a first pipe section to a second pipe section.

In accordance with still an additional feature of the invention, the pipe system is formed with outlet openings corresponding to the individual zones.

In accordance with another feature of the invention, the dryer includes a cooling zone suppliable with a portion of the heated gas.

In accordance with a further feature of the invention, the dryer includes temperature measuring elements for controlling the actuatable adjusting element.

In accordance with an added feature of the invention, at least one of the temperature measuring elements is for measuring the temperature of the material web.

In accordance with an additional feature of the invention, the temperature measuring elements are accommodated in the corresponding zones of the dryer.

In accordance with a concomitant feature of the invention, the dryer includes adjusting units for controlling the energy supply to the dryer, the adjusting units being guidable as a function of the temperature of one of the zones of the dryer or as a function of the temperature of the material web.

The embodiment according to the invention advantageously permits a large portion of the exhaust gas volume flow to be conducted to a process air burner where, over a dwell time that is of sufficient length, the volatile organic components in the exhaust gas can be burned. Because the process air burner is shielded from the atmosphere in the interior of the dryer, cracking of the volatile organic components cannot occur. Furthermore, due to the gradient of circulation of exhaust gas through the process air burner into the dryer interior, the percentage of exhaust gas which is supplied to a thermal afterburning device can be reduced. In this manner, the fuel costs for the dryer as well as for the afterburning device can be considerably reduced.

In advantageous embodiments of the concept underlying the invention, the dryer can include a large number of zones or only one or two of them. The dryer can furthermore be operated in accordance with the uniflow principle, web travel direction and air flow direction being the same, as well as the counterflow principle, wherein web travel direction opposes the air flow direction. The burner is preferably embodied as a process air burner which operates with an air ratio of $\lambda>1$. The volume flow of the exhaust gas is controlled by an actuatable adjusting element, which can be accommodated, for example, in a pipe system. Alternatively, the actuatable adjusting element can also be accommodated in an exhaust gas pipe.

The heat energy of the heated gas of the individual zones of the dryer can advantageously be supplied by a pipe system. The cross sections of this pipe system can decrease over the length of the dryer. Outlet openings are provided at the transition points of the various sections of the pipe system in order to conduct the heated gas to the individual dryer zones. A portion of the heated gas can also be conducted to a cooling zone of the dryer.

The actuatable adjusting element can be controlled via temperature sensors or thermal elements, which measure, for example, the temperature of the material web. Alternatively, the temperature sensors or thermal elements can also be disposed in the corresponding zones of the dryer. The adjusting elements that control the energy supply can also be guided as a function of the temperature measured.

Other features which are considered as characteristic for the invention are set forth in the appended claims.

Although the invention is illustrated and described herein as embodied in a dryer for a material web with exhaust gas recirculation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
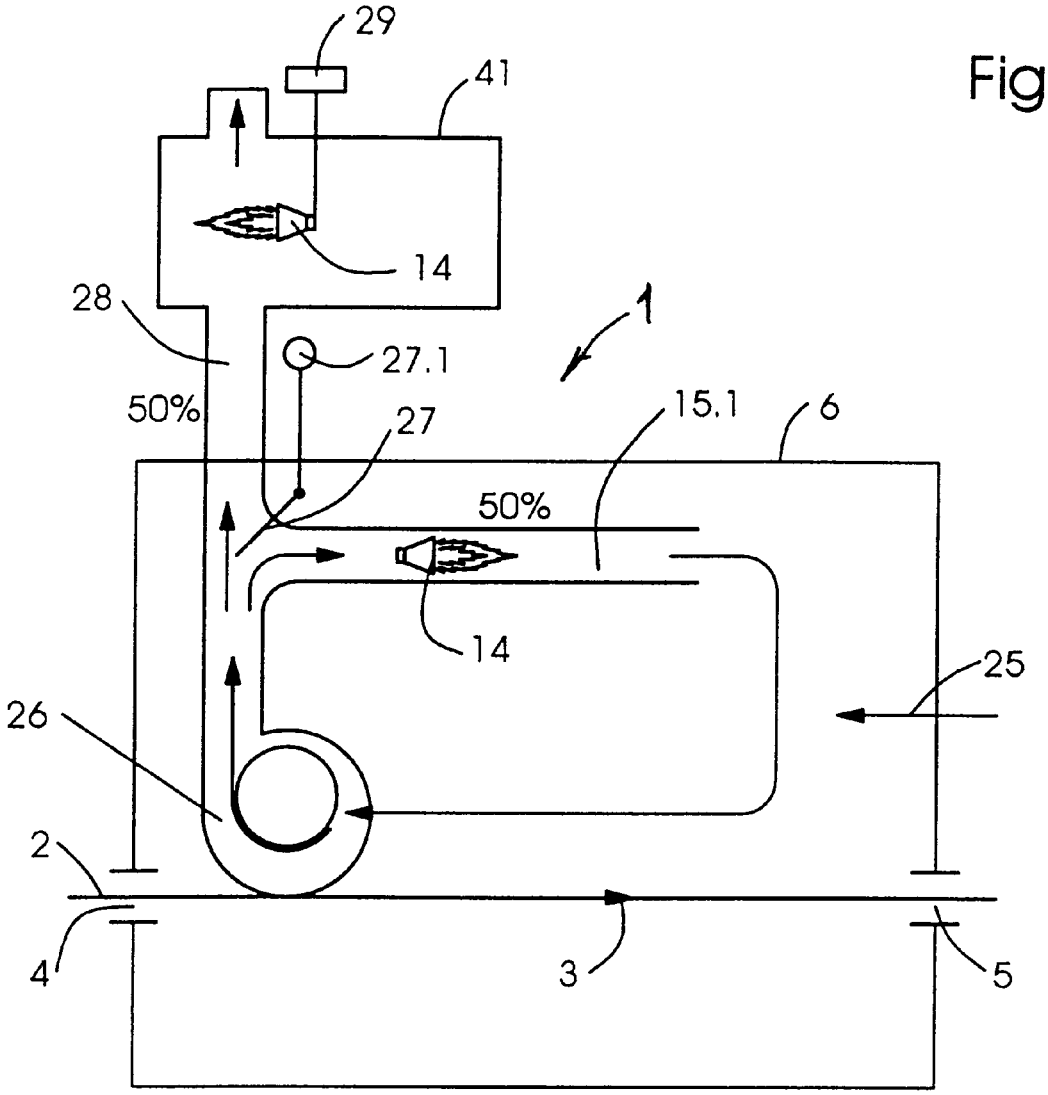
FIG. 1 is a diagrammatically represented dryer concept according to the invention.

Referring now to the drawings and, first, particularly to FIG. 1 thereof, there is shown therein a diagrammatic representation of a dryer concept according to the invention of the instant application. A dryer 1 for a material web 2 includes an inlet opening 4 and an outlet opening 5, through which a material web 2 moves in a web travel direction 3. A burner unit 14 is installed inside a first pipe section 15.1 of a pipe system 15. Exhaust gas is conveyed through an exhaust gas line 28 to an afterburning device 41 which is represented only diagrammatically here. A burner 14 is disposed in the afterburning device 41 in order to improve the exhaust gas quality so that it corresponds to the required standards. A fuel supply 29 is disposed outside the afterburning device 41.

With the aid of an actuatable adjusting element 27, which is connected to an adjusting unit 27.1, a large portion of the exhaust gas, up to 50%, can be conducted to the afterburning device 41, the quantity corresponding to this can be delivered to the first pipe section 15.1 in which the burner unit 14 is accommodated (approximately 50% in the example according to FIG. 1). A ventilator 26 which blows out exhaust gas is disposed in the interior 6 of the dryer; fresh air travels into the interior 6 of the dryer through openings 25 above the outlet opening 5.

Because the first pipe section 15.1 which contains the burner unit 14 is embodied as an elongated tube, the dwell time of the process gas can be considerably increased so that the volatile solvent components can be completely burned. In this manner, the process gas is able to be completely burned so that up to more than 95% of the volatile solvents are burned, as is explained further hereinbelow. Because a large portion of the exhaust gas is recirculated to the burner unit 14, only the remaining portion of the exhaust gas needs to be delivered to the afterburning device 41. The energy portion to be introduced into the afterburning device 41 is consequently reduced because it depends upon the quantity of the exhaust gas delivered to the afterburning device.

In connection with the dryer according to FIGS. 2 to 5, it should be determined that the respectively depicted dryer is operated in accordance with the counterflow principle, i.e., the web travel direction and the gas flow direction are opposed to one another. Naturally, the embodiment according to the invention can also be used in dryers which are operated in the uniflow mode, i.e., the web travel direction is the same as the flow direction.

Figure 2:
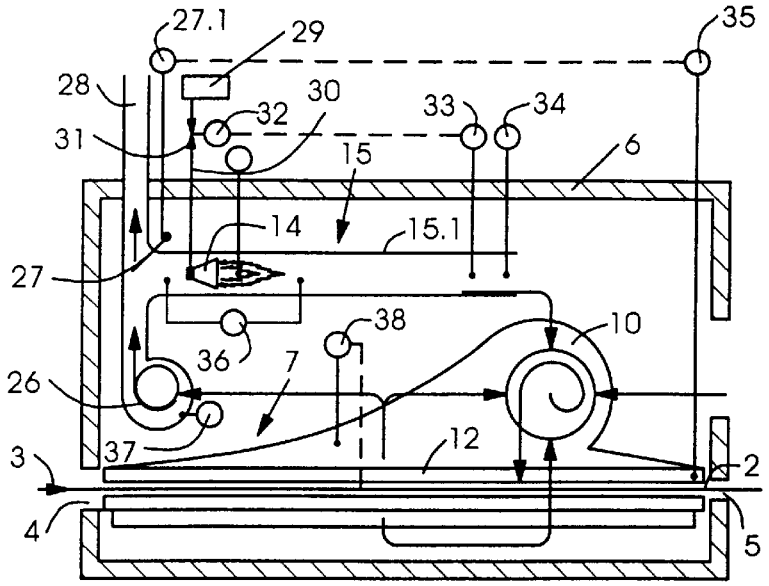
FIG. 2 is a simplified diagrammatic view of the dryer.

FIG. 2 shows a simplified view of the dryer according to the invention.

Inlet and outlet openings 4 and 5 are provided inside the housing 6 of the dryer 1, and the material web 2 moves through these openings in the direction represented by the arrowhead 3. A burner unit 14, possibly a process air burner, heats the process gas inside the first pipe section 15.1 to a temperature of approximately 700° C. The first pipe section 15.1 shields the flame and the process gas against the atmosphere of the dryer interior, against partially evaporated volatile solvent components, so that cracking of the volatile solvent components cannot occur. In addition, because a temperature of approximately 700° C. can be maintained along the length of the first pipe section 15.1, heated gas at this temperature is delivered to a first ambient air ventilator 10 of the first zone 7. The ventilator 10 mixes hot gas with ambient air in the first zone 10 and conveys it to a first nozzle section 12.

A ventilator 26 is disposed inside the first zone 7 and delivers exhaust gas to a pipe system 15, 28 within which an actuatable adjusting element 27 is installed. The exhaust gas quantity that is delivered to the afterburning device 41 and the burner unit 14 in the pipe system 15 is adjusted and controlled by the actuatable adjusting element 27. This offers the advantage of reducing the exhaust gas quantity to the afterburning device 41 and to thus save fuel costs thereat. The energy supply to the afterburning device 41 depends directly upon the exhaust gas volume flow supplied to it. Another significant advantage of the invention of the instant application is that the fuel consumption of the burner unit 14 is reduced, because the remaining exhaust gas volume flow that is not supplied to the afterburning device 41 is supplied to the process air burner 14. Due to the length of the first pipe section 15.1, the dwell time therein of the process gas can be extended to approximately 0.2 seconds. Consequently, a better conditioning of the heated gas can be achieved, because the length of the first pipe section 15.1 also prevents the flame from coming into contact with the volatile solvents that have already been partially evaporated in the first zone 7. A consequence thereof, in turn, is that cracking of the volatile solvents is prevented. The length of the first pipe section 15.1 permits the complete combustion of solvents, which remain contained in the exhaust gas, in the first pipe section 15.1. In this way, the energy still residing in the solvents can be used as an energy source for the dryer. Because the burner unit is a process air burner, it can be operated with a hyperstoichiometric air ratio of $\lambda>1$.

Figure 3:
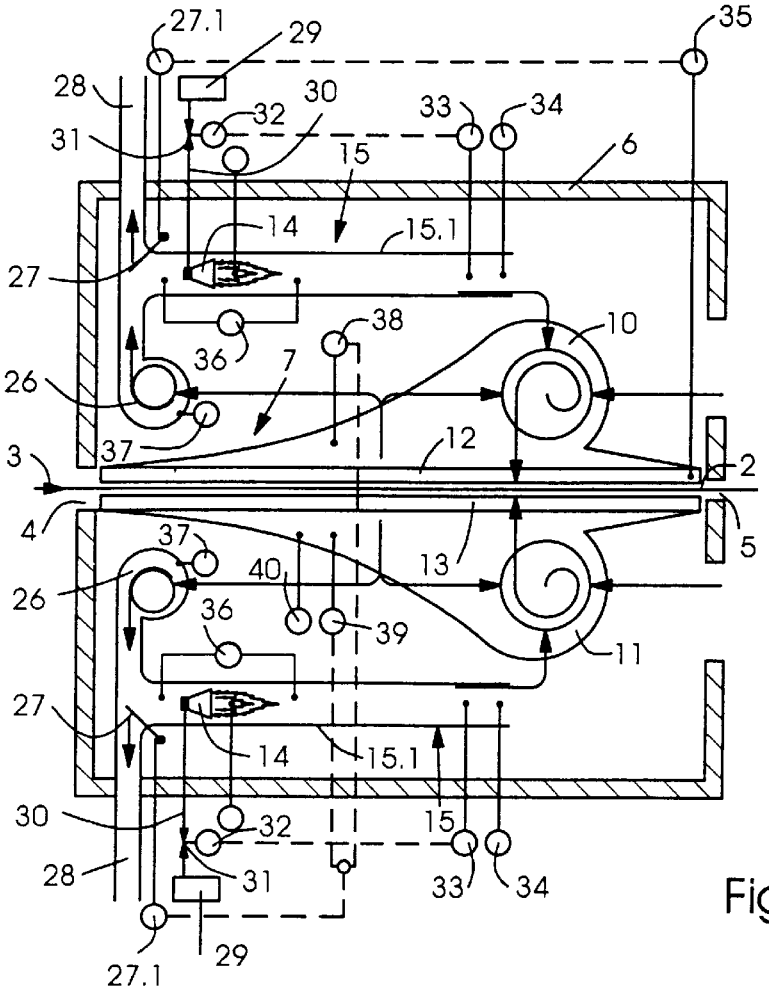
FIG. 3 is a view like that of FIG. 2 of a dryer according to the invention, which has a heating zone extending on both sides of a material web, but without a cooling zone.

FIG. 3 shows a dryer with a heating zone above and below the material web.

In this configuration, a process air burner 14 is contained in a first pipe section 15.1 on both sides, respectively, of a material web 2. The ambient air ventilators 10 and 11 are each supplied with heated gas from the pipe section 15.1. The ambient air ventilators 10 and 11 supply each of the nozzle sections 12 and 13 with the ambient air-gas mixture. Ventilators 26 are disposed inside the first zone 7, the heating zone of the dryer, in order to convey exhaust gas to the afterburning device 41 or the process air burner 14, each controlled by an actuatable adjusting element 27, 27.1, as has already been explained in connection with FIG. 1. Control of the adjusting units 27.1 for the adjusting element 27 can be effected either by a temperature sensor 35, possibly an infrared sensor, or by thermal elements 38 and 39, which are disposed in the first zone 7 of the dryer. The thermal elements 33 and 34 can be disposed inside the first pipe section 15.1, in order to measure the temperature of the process gas and to control an adjusting unit 32, which regulates the energy supply to the process air burner 14.

The adjusting unit 32 controls energy delivery from an energy supply 29 via a supply line 30 to the process air burner 14. The thermal elements 33 and 34 measure the temperatures at the end of the first pipe section 15.1.

Figure 4:
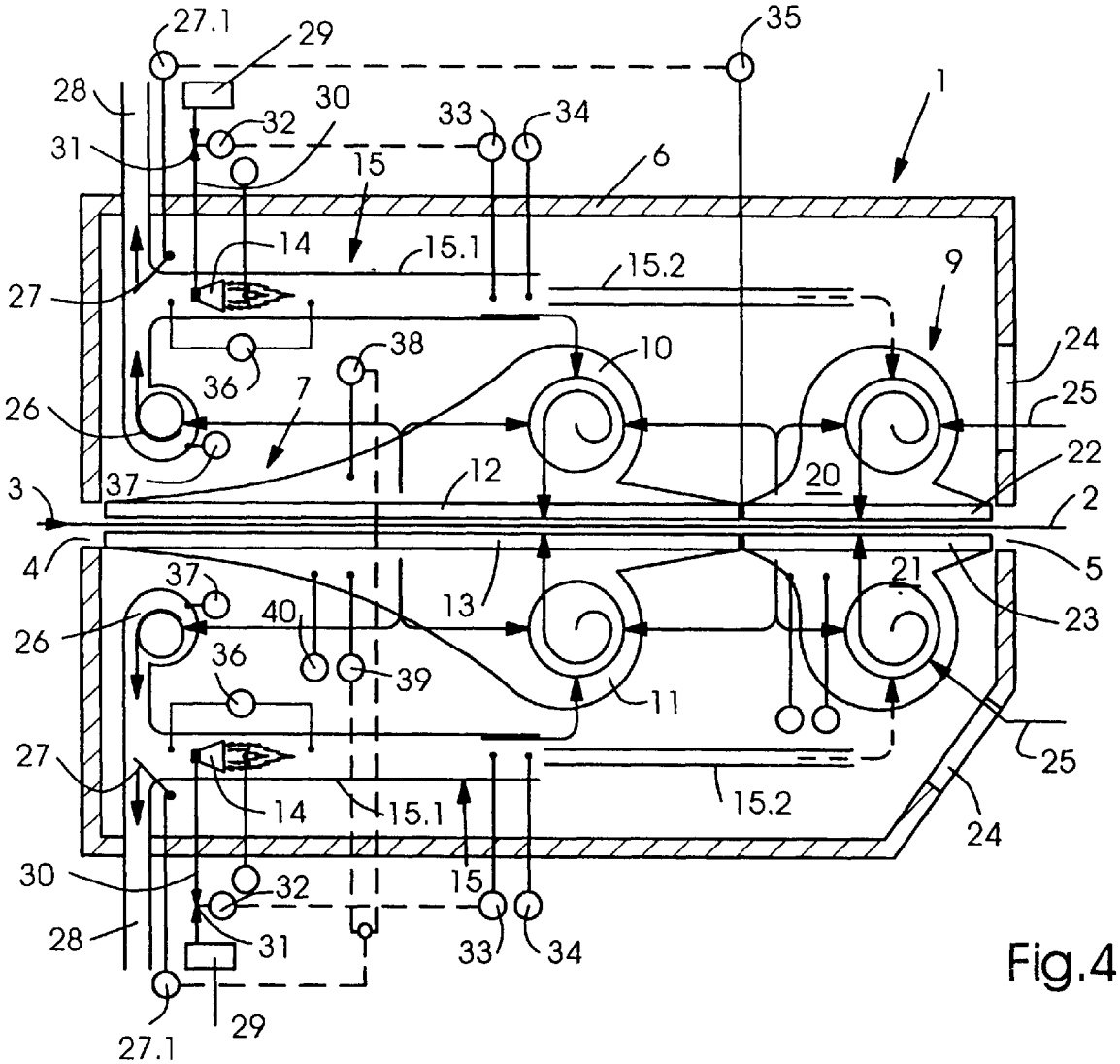
FIG. 4 is a more detailed diagrammatic longitudinal sectional view than that of FIG. 3 of the dryer with a first and second zone according to the invention.
Figure 5:
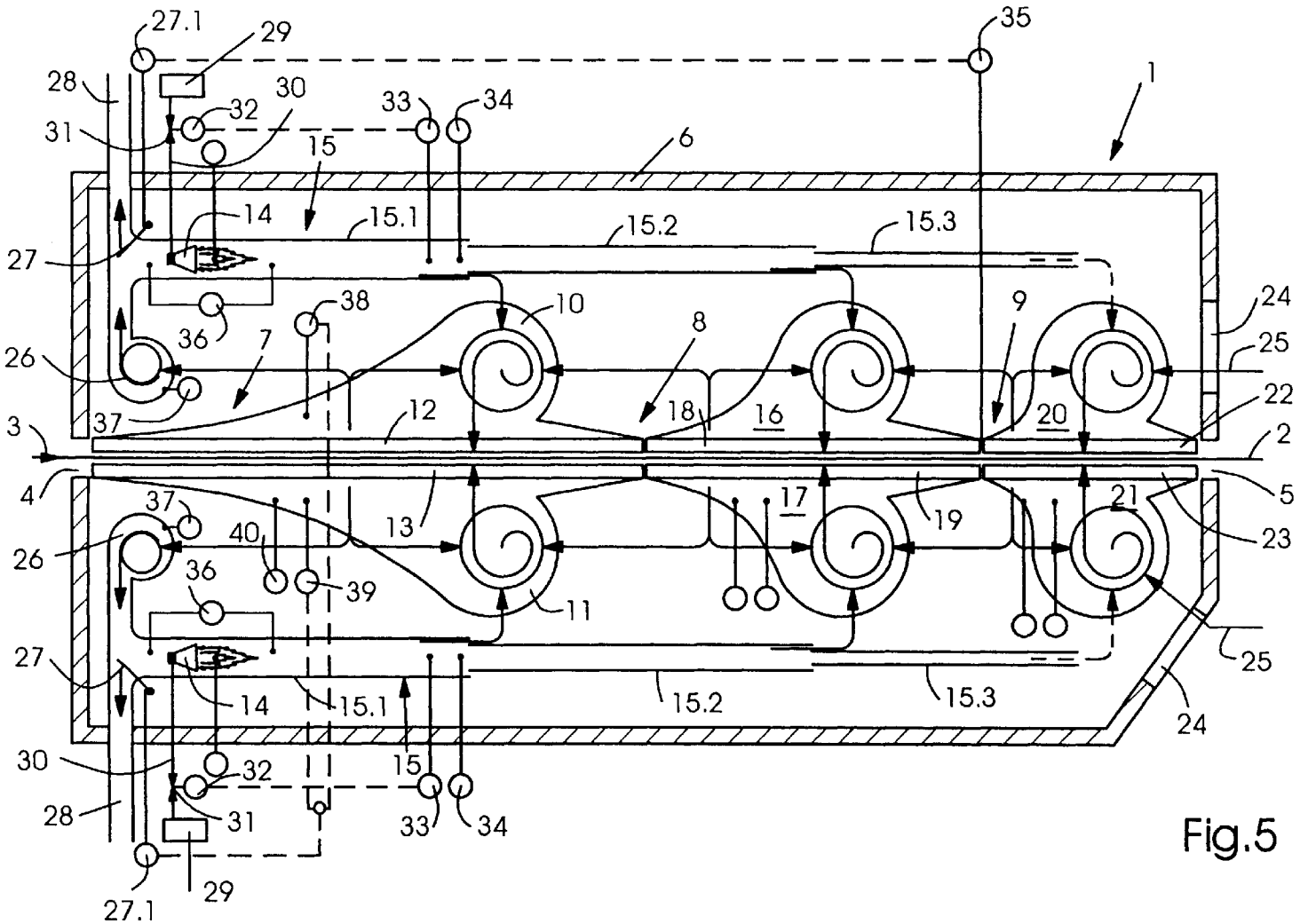
FIG. 5 is a view like that of FIG. 4, showing the dryer with a first zone and a cooling zone.

FIG. 4 shows an alternative embodiment of the invention of the instant application. A shortened dryer contains a heating zone 7 and a cooling zone 9. The solvent evaporation zone 8, as shown in FIG. 5 hereinafter, has been omitted. Consequently, the function of the solvent evaporating zone 8 is additionally assumed by the heating zone 7. A ventilator 26 for the exhaust gas is disposed in the first zone 7. An actuatable adjusting element 27, embodied as a three-way valve, is actuated by an adjusting unit 27.1 and controls the recirculation of exhaust gas to the pipe system 15. As explained hereinabove in connection with the embodiment according to FIG. 3, the adjusting unit 27.1 of the actuatable adjusting element 27 can be controlled either as a function of the temperature measured by an infrared sensor 35 or as a function of thermal elements 38 and 39, respectively, which are disposed in the first zone 7. Because the housing 6 of the dryer 1 is considerably shorter due to the omitted second zone 8, the pipe system 15 is also formed of only two sections, a first burner section 15.1 and a second section 15.2.

FIG. 5 shows a dryer with a first and a second zone before a cooling zone in the housing of the dryer. The surfaces of a material web 2 are dried inside the dryer 1, because the web is heated and the solvents are evaporated inside the housing 6. The housing 6 includes an inlet opening 4 and an outlet opening 5 for the material web 2, which moves in the web travel direction 3, as already indicated by the arrow in FIG. 4. In a transition region from the first pipe section 15.1 to the second pipe section 15.2, the pipe system 15 conveys heated gas to the first zone and, in fact, to the first ambient air ventilators 10 and 11. The second zone 8 shown in FIG.

5, i.e., the solvent evaporation zone, is equipped with second ambient air ventilators 16 and 17, which are supplied with heated gas from a transition region between the second pipe section 15.2 and the third pipe section 15.3. Heated gas is supplied to nozzle sections 18 and 19, which guide the material web 2 without coming into contact therewith. Finally, the pipe system 15 conducts heated gas to the cooling zone 9, where it emerges at the end of the third pipe section 15.3. The cooling zone 9 is also equipped with ambient air ventilators 20 and 21, which supply the nozzle sections 22 and 23 of the cooling zone 9 with heated gas. Openings 24 are provided in the housing 6 in the region of the cooling zone 9, and these openings 24, with the aid of the ambient air ventilators 20 and 21, permit entry of fresh air, as indicated by the arrows in FIG. 5.

Heated gas from the pipe system 15 is recirculated by the ambient air ventilators 10 and 11; 16 and 17; and 20 and 21.

As described hereinabove, the pipe system 15 includes pipe sections 15.1, 15.2, and 15.3, which are respectively connected in series. These permit a simple and reliable heat transport over the entire length of the dryer 1. In this manner, the formation of pockets with high or low temperature levels is considerably reduced; furthermore, the temperature level can be reduced due to the longer dwell time of the combustion mixture in the pipe system. In addition to the ambient air ventilators in zone 7, another ventilator 26 is also provided there and is connected to an exhaust gas pipe 28 and a pipe system 15 which contains the process air burner 14. By the use of the ventilator 26, the exhaust gas can either be supplied directly into the exhaust gas pipe 28 to the afterburning device 41 or can be supplied as a process gas to the process air burner 14 by the pipe system 15. The quantity of recirculated exhaust gas from zone 7 is a function of the position of the actuatable adjusting element 27, which functions as a three-way valve between the exhaust gas pipe 28 and the pipe system 15.

The heated gas is conveyed to the first zone 7, the heating zone, wherein the upper and lower ventilators 10 and 11 heat the material web 2 before the evaporation of solvents. Consequently, the ventilator 26 in zone 7 can conduct exhaust gas to the process air burner 14. If the actuatable adjusting element 27, which can be actuated by the adjusting unit 27.1, assumes the position shown in FIG. 4, a large portion of the exhaust gas is purified and reused in the dryer. The heated gas, which is supplied to the first zone 7 by the upper and lower ambient air ventilators 10 and 11, heats the material web 2, this heated gas being free of any solvents. Due to the longer dwell time of the process gas in the first pipe section 15.1, these solvents are completely burned. Consequently, the heated gas can easily be recirculated to process air burners 14, which can be contained in upper and lower pipe systems 15.

The adjusting unit 27.1 for the actuatable adjusting element 27 is connected to an infrared sensor 35 which measures the temperature in the housing 6. If the measured temperature exceeds a particular threshold, the actuatable adjusting element 27 opens the exhaust gas pipe 28 a little more so that the recirculated exhaust gas flow conveyed to the pipe system 15 is reduced. But if the temperature sensor 35 registers a temperature which lies below the particular threshold, then the actuatable adjusting element 27 is moved precisely into the position shown in FIG. 4. In this instance, the temperature of the heated gas in the pipe system 15, i.e., in the first pipe section 15.1, can be measured by a thermal element 33. The thermal element 33 measures the temperature of the heated gas at the end of the first pipe section 15.1. An adjusting unit 32 can be activated as a function of the measured value of the temperature, in order to control a valve 31, which is provided in the energy supply line 30 from the energy supply 29 to the burner unit 14.

Inside the pipe system 15, the burner unit 14 is associated with a pair of pressure transducers 36, which measure the pressure prevailing before and after the combustion. Another pressure transducer 37 is associated with the exhaust gas ventilator 26 in the first zone 7. Furthermore, other thermal elements 38 and 39, respectively, are provided on both sides of the material web 2. The temperatures that are measured by these thermal elements 38 and 39 are used for controlling the adjusting unit 27.1 for the actuatable adjusting element 27, in order to influence the position thereof. This device represents an alternative to controlling the actuatable adjusting element 27 via an infrared sensor 35.

Although not described in extensive detail, the ventilators 17 and 21 of the zone 8, i.e., the solvent evaporation or vaporization zone, and those of the cooling zone 9 can be equipped with thermal elements in order to offer a process control which extends over the entire length of the dryer.

We claim:

1. A dryer for material webs for supplying heat to at least one side of a material web, including a dryer housing formed with an inlet opening and an outlet opening for material webs, and at least one ventilator and at least one heating device for producing heated gas, comprising a pipe system;

a burner unit included in said pipe system and shielded against the atmosphere in the dryer, a supply system for supplying said burner unit with process gas formed of a large portion of exhaust gas of the dryer, the process gas being maintained for a dwell time and at a temperature level adequate for complete combustion of volatile solvents before it is supplied once again as heated gas to the interior of the dryer and to an afterburning device.

2. The dryer according to claim 1, wherein said burner unit is a process air burner.

3. The dryer according to claim 1, including an actuatable adjusting element for controlling exhaust gas volume flow.

4. The dryer according to claim 1, including a plurality of zones formed therein.

5. The dryer according to claim 1, wherein the dryer is operatable in accordance with the counterflow principle.

6. The dryer according to claim 1, wherein the dryer is operatable in accordance with the uniflow principle.

7. The dryer according to claim 3, wherein, said actuatable adjusting element is disposed in said pipe system.

8. The dryer according to claim 3, further including an exhaust gas pipe, said actuatable adjusting element being disposed in said exhaust gas pipe.

9. The dryer according to claim 4, wherein said pipe system distributes the heat energy to the respective zones.

10. The dryer according to claim 9, wherein said pipe system includes pipe sections having a respective cross section which diminishes over the length of the pipe system.

11. The dryer according to claim 9, including first ventilators for receiving a supply of heated gas, said first ventilators being disposed at a transition region from a first pipe section to a second pipe section.

12. The dryer according to claim 9, wherein said pipe system is formed with outlet openings corresponding to the individual zones.

13. The dryer according to claim 9, including a cooling zone suppliable with a portion of the heated gas.

14. The dryer according to claim 3, including temperature measuring elements for controlling said actuatable adjusting element.

15. The dryer according to claim 14, wherein at least one of said temperature measuring elements is for measuring the temperature of the material web.

16. The dryer according to claim 14, wherein said temperature measuring elements are accommodated in the corresponding zones of the dryer.

17. The dryer according to claim 4, including adjusting units for controlling the energy supply to the dryer, said adjusting units being guidable as a function of the temperature of one of the zones of the dryer or as a function of the temperature of the material web.

* * * * *